US010151275B2

(12) United States Patent
Mani et al.

(10) Patent No.: US 10,151,275 B2
(45) Date of Patent: Dec. 11, 2018

(54) FUEL VAPOR PROCESSING APPARATUS

(71) Applicant: AISAN KOGYO KABUSHIKI KAISHA, Obu-shi, Aichi-ken (JP)

(72) Inventors: Takashi Mani, Takahama (JP); Wenbin Yang, Nagoya (JP)

(73) Assignee: AISAN KOGYO KABUSHIKI KAISHA, Obu-Shi, Aichi-Ken (JP)

( * ) Notice: Subject to any disclaimer, the term of this patent is extended or adjusted under 35 U.S.C. 154(b) by 0 days.

(21) Appl. No.: 15/859,343

(22) Filed: Dec. 30, 2017

(65) Prior Publication Data

US 2018/0195468 A1 Jul. 12, 2018

(30) Foreign Application Priority Data

Jan. 11, 2017 (JP) ..... 2017-002411

(51) Int. Cl.
*F02M 1/00* (2006.01)
*F02M 25/08* (2006.01)

(52) U.S. Cl.
CPC ..... *F02M 25/0818* (2013.01); *F02M 25/089* (2013.01); *F02M 25/0854* (2013.01)

(58) Field of Classification Search
CPC ..... F16L 37/0841; F16L 37/098
USPC ..... 123/516, 518; 285/235, 236, 305, 319
See application file for complete search history.

(56) References Cited

U.S. PATENT DOCUMENTS 8,151,768 B2 4/2012 Kaneda et al.
2001/0040377 A1* 11/2001 Bandlow ..... F16L 37/0985 285/319
2004/0183295 A1* 9/2004 Kasahara ..... F16L 37/0987 285/93
2005/0173923 A1* 8/2005 Ketcham ..... F16L 37/0987 285/319
2007/0228727 A1* 10/2007 Matsuno ..... F16L 37/0985 285/305
2011/0101679 A1* 5/2011 Crigler ..... E04C 5/10 285/235
2013/0127159 A1* 5/2013 Honda ..... B60K 15/04 285/305
2015/0204469 A1* 7/2015 Arnold ..... F16L 21/08 285/305
2015/0335517 A1* 11/2015 Posener ..... A61H 9/005 601/151

(Continued)

FOREIGN PATENT DOCUMENTS

JP 2010106712 A 5/2010
JP 2013053575 A 3/2013

*Primary Examiner* — John Kwon
(74) *Attorney, Agent, or Firm* — Conley Rose, P.C.

(57) ABSTRACT

A snap-fit attaching device may attach an accessory device to an attachment unit that may be integrated with or connected to a main unit. The attachment device may include a first structural member and a second structural member. The first structural member includes a slot that defines an engaging opening forming member. The engaging opening forming member is supported at a support portion in a cantilever manner so as to be resiliently deformable. An engaging opening is formed in the engaging opening forming member. The first structural member further includes a bridging member defining a part of the slot and disposed at a position opposite to the support portion. The second structural member includes an engaging projection for engagement with the engaging opening.

17 Claims, 17 Drawing Sheets

(56) References Cited

U.S. PATENT DOCUMENTS

| | | | | |
|---|---|---|---|---|
| 2016/0186906 | A1* | 6/2016 | Blake | A61M 39/1011<br>285/319 |
| 2017/0205013 | A1* | 7/2017 | Smith | F16L 41/065 |
| 2018/0106396 | A1* | 4/2018 | Morton | F16L 9/22 |

* cited by examiner

FUEL VAPOR PROCESSING APPARATUS

CROSS-REFERENCE TO RELATED APPLICATIONS

This application claims benefit of Japanese Patent Application Serial No. 2017-002411 filed on Jan. 11, 2017, and entitled "Fuel Vapor Processing Apparatus," which is hereby incorporated by reference in its entirety for all purposes.

STATEMENT REGARDING FEDERALLY SPONSORED RESEARCH OR DEVELOPMENT

Not applicable.

BACKGROUND

The disclosure generally relates to a fuel vapor processing apparatus.

A known fuel vapor processing apparatus includes a main device and an accessory device that can be attached to the main device. The main device receives and processes fuel vapor that may be produced in a fuel tank of an automobile. The main device may be a canister containing adsorbent, such as activated carbon, for adsorbing the fuel vapor produced in the fuel tank. The accessory device may be a pump unit used when a leakage diagnosis is made for the canister. The pump unit may supply pressurized air into the canister, so that a fault with the canister can be determined based on a leakage of the pressurized air from the canister.

The canister (the main device) may include a main unit and an attachment unit for attaching the accessory device (pump unit) to the main unit. The main unit has a storage chamber for containing the adsorbent. The canister and the accessory unit may be connected to each other via a fuel vapor passage.

JP-A-2010-106712 discloses a snap-fit attaching device for attaching the accessory device to the main device (i.e., the main unit including the attachment unit). The snap-fit attaching device may include a combination of an engaging projection and an engaging opening for engaging the engaging projection. The engaging projection may be provided on the side of the accessory device, and the engaging opening may be provided on the side of the attachment unit. Moving the main device and the accessory device in an attaching direction relative to each other may cause engagement (snap-fitting) of the engaging projection with the engaging opening, so that the accessory device can be attached to the main unit by the snap-fit attaching device.

In JP-A-2010-106712, as shown in FIG. 21, an opening forming member 1213 forming an engaging opening 1222 of the snap-fit attaching device has a cantilever support structure for elastic deformation. Therefore, an engaging projection 1320 of the snap-fit attaching device can engage the engaging opening 1222 through elastic deformation of the opening forming member 1213. To this end, slits 1211 are formed around the opening forming member 1213 to define free peripheral edges excluding a cantilever support portion 1214.

BRIEF SUMMARY

In one aspect according to the present disclosure, a fuel vapor processing apparatus may include a main device, an accessory device, and a snap-fit attaching device. The main device may receive and process fuel vapor produced in a fuel tank and may include a main unit and an attachment unit that communicate with each other via a fuel vapor passage. The attachment unit may include a first structural member. The accessory device may include a second structural member. The snap-fit attaching device may attach the second structural member to the first structural member and may include a slot formed in the first structural member, an engaging opening forming member defined by the slot, and an engaging opening formed in the engaging opening forming member. The slot may surround the engaging opening forming member, so that the engaging opening forming member is supported by the first structural member in a cantilever manner at a support portion so as to be elastically deformable. The snap-fit attaching device may further include an engaging projection disposed at the second structural member. The engaging projection may engage the engaging opening through elastic deformation of the engaging opening forming member when the second structural member moves relative to the first structural member in an attaching direction. The first structural member may further include a bridging portion facing a part of the slot on a side opposite to the support portion. The bridging portion may connect portions of the first structural member disposed on opposite sides of the engaging opening forming member with respect to a direction along the part of the slot.

With this construction, the accessory device can be attached to the attachment unit of the main device via the snap-fit attachment device. Therefore, the attachment operation can be easily performed through engagement of the engaging projection with the engaging opening.

Further, because the bridging portion of the first structural member connects portions of the first structural member disposed on opposite sides of the engaging opening forming member, it is possible to improve the rigidity of a region of the first structural member around the slot. Therefore, it is possible to prevent or minimize potential vibrations of the accessory device.

In one embodiment, the bridging portion may be configured not to interfere with the engaging projection during the movement of the second structural member in the attaching direction.

With this arrangement, the engaging operation of the engaging projection with the engaging opening can be smoothly performed.

In another embodiment, the first structural member may further include a reinforcement rib structure disposed around the engaging opening forming member and formed integrally with the first structural member.

With this arrangement, it is possible to further improve the rigidity of the region around the slot. Therefore, potential vibrations of the accessor device can be further prevented or minimized.

In a further embodiment, the accessory unit may be a pump unit used for a failure diagnosis of the fuel vapor processing apparatus.

Although the pump unit used for the failure diagnosis may be relatively heavy, the attachment device can reliably support the pump unit and can prevent or minimize potential vibrations of the pump unit.

In a further embodiment, the main unit of the main device may be a canister that contains adsorbent.

In a further embodiment, the main unit and the attachment unit of the main device may be integrated with each other.

By integrating the attachment unit with the main unit, it may be possible to configure the main device to be compact. Therefore, it is possible to minimize the space necessary for installation of the main device on the vehicle.

In an alternative embodiment, the main unit and the attachment unit of the main device may be separated from each other and may be connected to each other via a communication pipe.

With this arrangement, it is possible to improve a freedom in the arrangement of the main unit and the attachment unit under the floor of the vehicle, so that the arrangement position of these units can be easily set.

In a further embodiment, the attachment unit of the main device may contain adsorbent.

With this construction, the absorbent may be contained in both of the main unit and the attachment unit. Therefore, it is possible to enhance an ability of the main device for adsorbing fuel vapor.

Alternatively, the attachment unit of the main device may contain no adsorbent.

With this construction, it is possible to simplify the design of the attachment unit.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of the preferred embodiments of the invention, reference will now be made to the accompanying drawings in which.

DETAILED DESCRIPTION OF EXEMPLARY EMBODIMENTS

Figure 21:
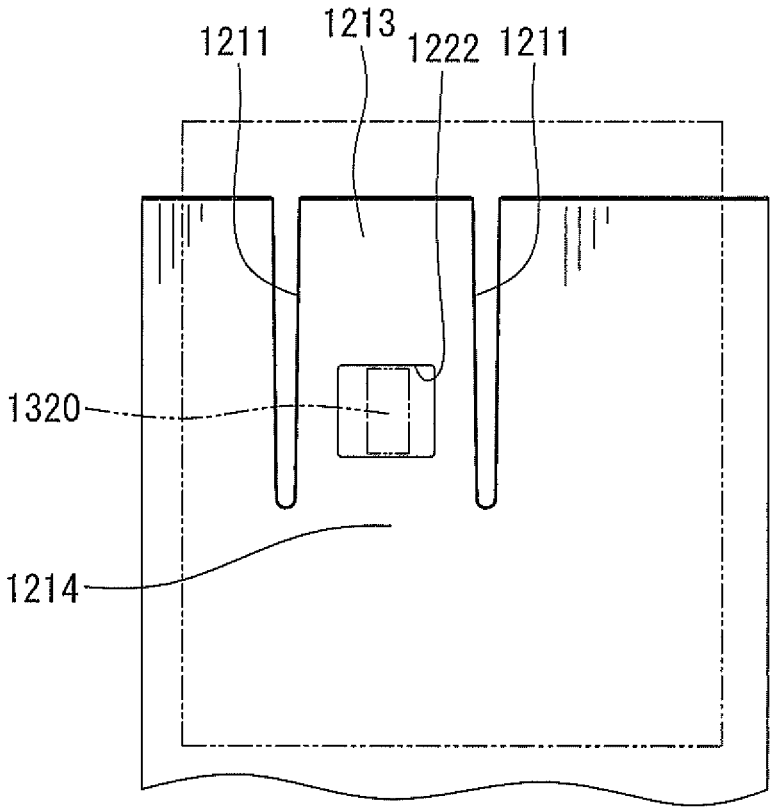
FIG. 21 PRIOR ART
FIG. 21 is a view of a snap-fit attachment device of a related art.

As previously described, in JP-A-2010-106712, slits 1211 are formed around the opening forming member 1213 to define free peripheral edges excluding a cantilever support portion 1214. As a result, the rigidity of the peripheral structure (i.e., the support structure) of the opening forming member 1213 is relatively low. In fact, a result of a travelling test of a vehicle (automobile) incorporating the above snap-fit structure has showed that the accessory device (pump unit) vibrates in some cases. The vibration of the accessory device was remarkable especially when a strong vibration is applied to the accessory device during travelling of the vehicle on a wavey highway road surface. In FIG. 21, the accessory device (pump unit) is indicated by two-dot chain lines, and the attaching unit of the main device is indicated by solid lines. Accordingly, there is a need in the art for apparatus and methods for preventing or minimizing potential vibrations of an accessory device by improving the rigidity of the snap-fit attaching device.

Embodiments will now be described with reference to the drawings. In these embodiments, a canister is embodied as an example of a main device, and an accessory unit is embodied as a pump unit. The pump unit may be attached to the canister for use when a leakage diagnosis is performed for the canister during stopping of a vehicle engine.

A first embodiment will now be described with reference to FIGS. 1 to 13. In this embodiment, a canister 20 serving as the main device may include a main unit 20A and an attachment unit 20B that are integrated with each other. A pump unit 30 may serve as an accessory device for attachment to the attachment unit 20B.

Figure 1:
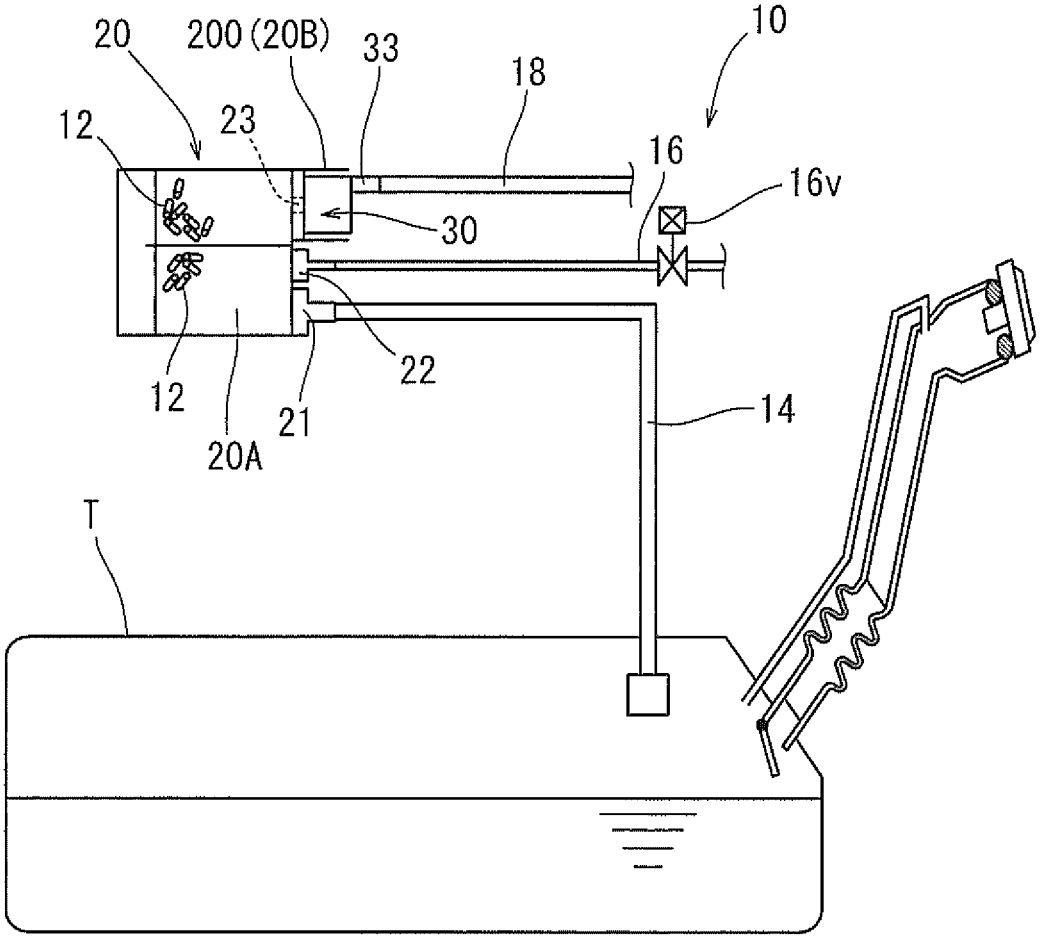
FIG. 1 is a schematic view of an embodiment of a fuel vapor processing apparatus in accordance with principles described herein.

Referring first to FIG. 1, a fuel vapor processing apparatus 10 incorporating the canister 20 and the pump unit 30 is schematically shown. The fuel vapor processing apparatus 10 may process fuel vapor that is produced in a fuel tank T. More specifically, the fuel vapor processing apparatus 10 may prevent fuel vapor from leaking to the atmosphere. The fuel vapor processing apparatus 10 may generally include the canister 20, a fuel vapor passage 14, a purge passage 16, and an atmospheric passage 18. The canister 20 may contain adsorbent 12 that can adsorb fuel vapor. For example, the adsorbent 12 may be activated carbon. The internal space of the fuel tank T may communicate with the canister 20 via the fuel vapor passage 14. The canister 20 may communicate with an intake passage of a vehicle engine (not shown) via the purge passage 16. The canister 20 may communicate with the outside (i.e., atmosphere) via the atmospheric passage 18.

The fuel vapor passage 14 may be connected to a tank port 21 of the canister 20, and the purge passage 16 may be connected to a purge port 22 of the canister 20. A solenoid valve 16*v* may be disposed in the purge passage 16 for opening and closing same. The atmospheric passage 18 may be connected to the atmospheric port 23 of the canister 20 via the pump unit 30, which may be used when a leakage diagnosis is performed for the fuel vapor processing apparatus 10.

During stopping of the engine, fuel vapor may be introduced from within the fuel tank T into the canister 20 via the fuel vapor passage 14, so that the fuel vapor can be adsorbed by the adsorbent 12 of the canister 20. Here, during stopping of the engine, the solenoid valve 16*v* of the purge passage 16 may be closed, and therefore, no fuel vapor may flow into the intake passage of the engine.

During the operation of the engine, the solenoid valve 16*v* may be opened, so that a negative pressure of the intake passage may be applied to the canister 20. In addition, atmospheric air may flow into the canister 20 via the atmospheric passage 18, the pump unit 30, and the atmospheric port 23. Therefore, the fuel vapor adsorbed by the adsorbent 12 may be desorbed from the adsorbent 12 and drawn into the intake passage of the engine. In this manner, fuel vapor produced in the fuel tank T may be prevented from flowing into the atmosphere.

A leakage diagnosis for the fuel vapor processing apparatus 10 may be performed at a predetermined point of time during stopping of the engine. For preforming the leakage diagnosis, the pump unit 30 may be driven to discharge gas from within the canister 20 to the outside via the atmospheric passage 18, so that a negative pressure may be produced in the canister 20, the fuel vapor passage 14 and the purge passage 16. The negative pressure of the canister 20, etc. may be monitored during a predetermined period for determining whether or not leakage occurs.

As explained previously, the pump unit 30 serves as an accessory device, and the canister 20 serves as a main device. In this embodiment, the attachment unit 20B for attaching the pump unit 30 to the canister 20 may include an outer wall portion 200 of the canister 20. The main unit 20A may be a major portion of the canister 20 excluding the outer wall portion 200. In this embodiment, the main unit 20A and the attachment unit 20B are integrated with each other.

As shown in FIGS. 8 to 12, the pump unit 12 may include a pump housing 31. A pump and a motor (both not shown) for driving the pump may be disposed within the pump housing 31.

Figure 5:
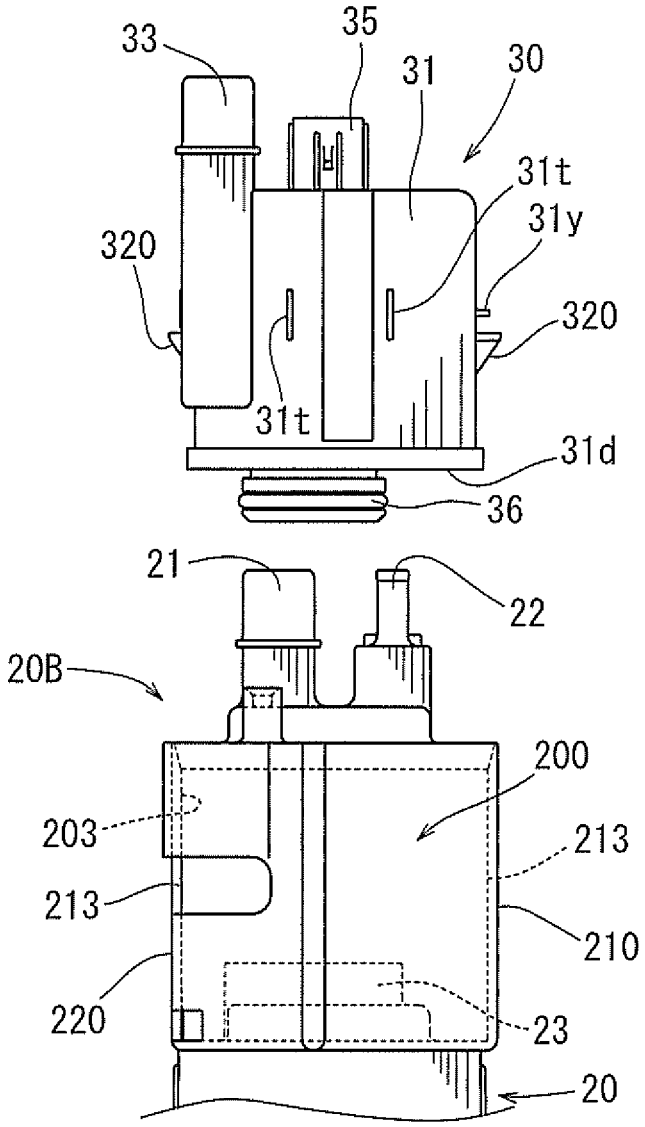
FIG. 5 is a side view showing the attaching operation for attaching the pump unit to the canister of FIG. 2.

The pump housing 31 may have a substantially rectangular box shape. A relatively short communication pipe 36 for connection with the atmospheric port 23 of the canister 20 may extend downward from a substantially central portion of a lower surface 31*d* of the pump housing 31 (FIG. 5). An outlet port 33 for connection with the atmospheric port 18 (FIG. 1) may be formed on one of corner portions of the pump housing 31 to extend along the corresponding corner portion in a top-to-down direction (i.e., a direction parallel to the axial direction of the communication pipe 36). A connector 35 for electrically connecting to a cable connector (not shown) for the motor may be formed on an upper surface 31*u* of the pump housing 31 to extend upward therefrom.

Figure 8:
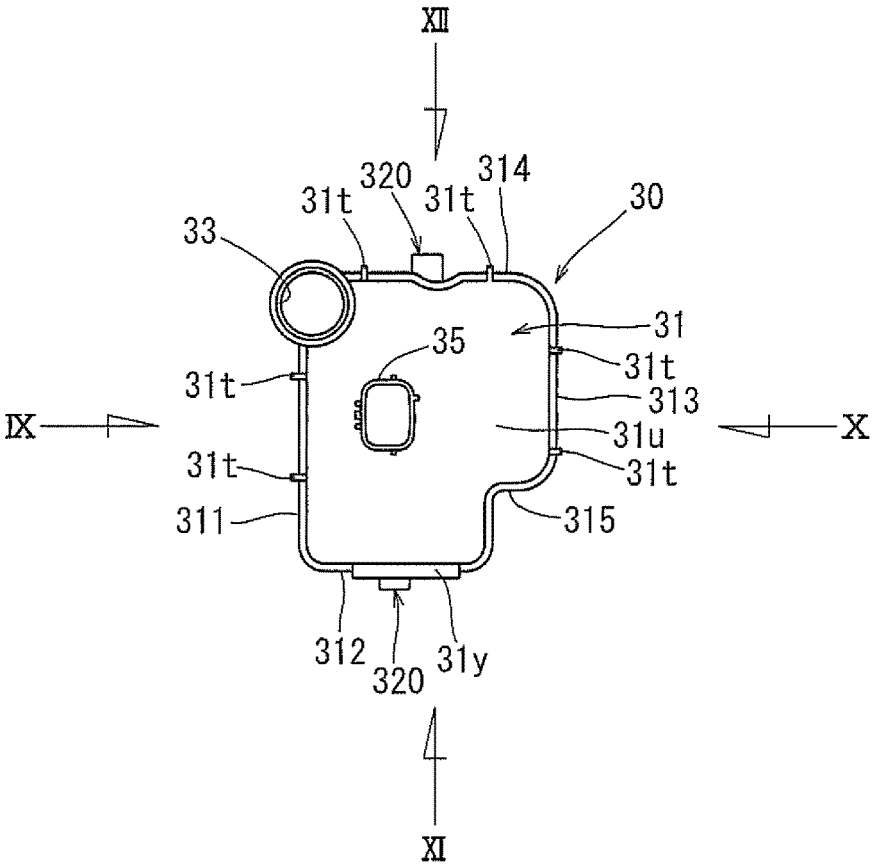
FIG. 8 is a front view of the pump unit of FIG. 2.

As shown in FIG. 8, the outer peripheral surface of the pump housing 31 may include a first outer peripheral surface portion 311, a second outer peripheral surface portion 312, a third outer peripheral surface portion 313, a fourth outer peripheral surface portion 314, and a concave surface portion 315 formed between the second outer peripheral surface portion 312 and the third outer peripheral surface portion 313. The outlet port 33 mentioned above may be disposed at the corner portion between the first outer peripheral surface portion 311 and the fourth outer peripheral surface portion 314. Each of the first to fourth outer peripheral surface portions 311, 312, 313, 314 may be configured as a flat surface portion.

Figure 11:
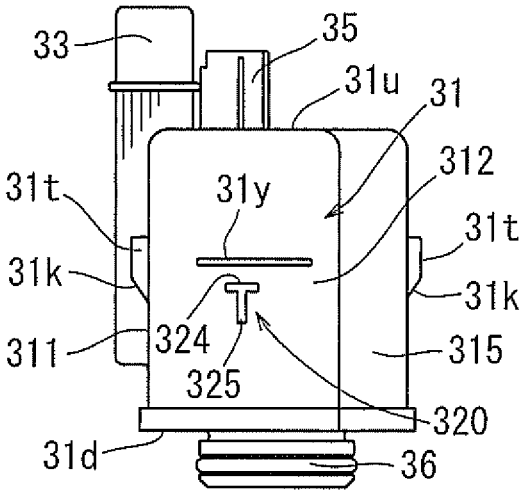
FIG. 11 is a side view of the pump unit of FIG. 2 as viewed in a direction indicated by arrow XI in FIG. 8.
Figure 12:
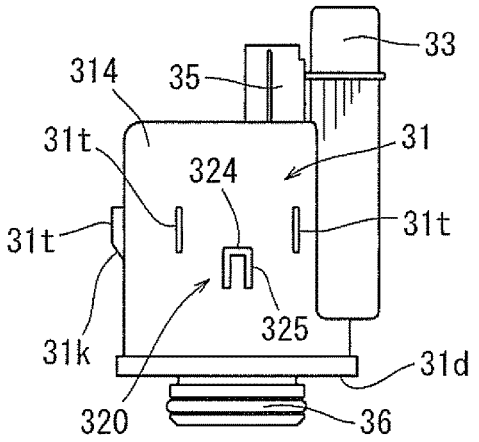
FIG. 12 is a side view of the pump unit of FIG. 2 as viewed in a direction indicated by arrow XII in FIG. 8.

As shown in FIG. 8, a pair of lengthwise linear projections 31*t* may be formed on each of the first outer peripheral surface portion 311, the third outer peripheral surface portion 313 and the fourth outer peripheral surface portion 314 to extend parallel to each other in a lengthwise direction of the pump housing 31 along the corresponding outer peripheral surface portion. When the pump housing 31 is fitted into an outer peripheral wall 200 of the canister 20 as will be explained later, each pair of lengthwise linear projections 31*t* may be located within a gap formed between the inner peripheral surface of the outer peripheral wall 200 of the canister 20 and the corresponding first, third, or fourth outer peripheral surface portion 311, 313 314, respectively, so that it may be possible to prevent potential shifting movement (rattling) between the outer peripheral wall 200 and the corresponding outer peripheral surface portion 311, 313 314. As shown in FIGS. 11 and 12, the lower end portion as viewed in these figures of each of the lengthwise linear projections 31*t* may be formed to have an inclined surface 31*k* to enable smooth fitting of the pump housing 31 into the canister 20.

As shown in FIG. 11, a crosswise linear projection 31*y* may be formed on the second outer peripheral surface portion 312 at a substantially central position thereof with respect to the lengthwise direction. Similar to the lengthwise linear projections 31*t*, the crosswise linear projection 31*y* may be located within a gap that may be formed between the inner peripheral surface of the outer peripheral wall 200 of the canister 20 and the second outer peripheral surface portion 312, so that it may be possible to prevent potential shifting movement (rattling) between the outer peripheral wall 200 and the second outer peripheral surface portion 312.

Figure 9:
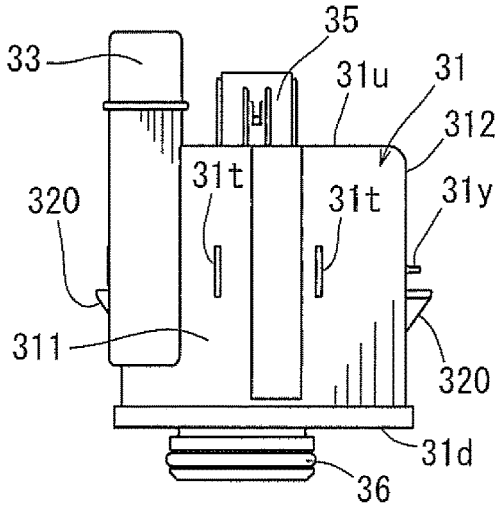
FIG. 9 is a side view of the pump unit of FIG. 2 as viewed in a direction indicated by arrow IX in FIG. 8.
Figure 10:
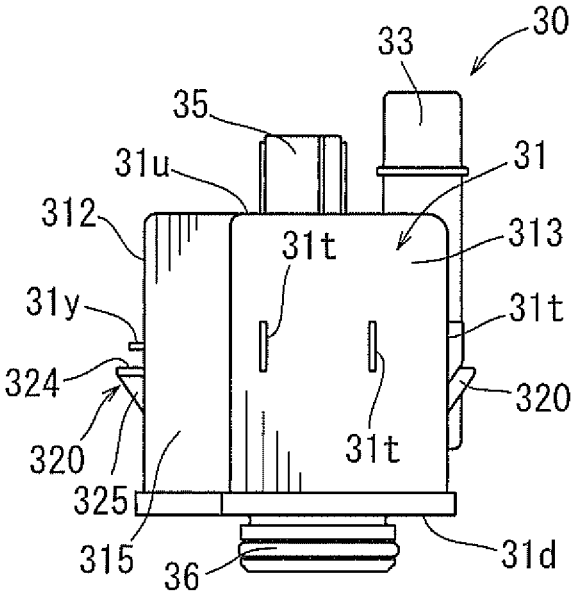
FIG. 10 is a side view of the pump unit of FIG. 2 as viewed in a direction indicated by arrow X in FIG. 8.

As shown in FIGS. 11 and 12, a substantially shelf-like engaging step portion 320 may be formed on each of the second outer peripheral surface portion 312 and the fourth outer peripheral surface portion 314 at a position slightly lower than the substantially central position thereof with respect to the vertical direction as viewed in FIGS. 11 and 12 (i.e., lengthwise direction). The engaging step portion 320 may serve to engage an engaging opening 222 formed in the outer peripheral wall 200 of the canister 20 as will be explained later. As shown in FIGS. 9 and 10, the engaging step portion 320 of each of the second outer peripheral surface portion 312 and the fourth outer peripheral surface portion 314 may include a flat-plate shaped step body 324 and a rib portion 325. In this embodiment, the engaging step portion 320 of the second outer peripheral portion 312 may have a T-shape as shown in FIG. 11, while the engaging step portion 320 of the fourth outer peripheral surface portion 314 may have a substantially inverted U-shape as shown in FIG. 12. The step body 324 may protrude perpendicular to the corresponding outer peripheral surface portion 312 or 314. The rib portion 325 may have a triangular shape as viewed from the lateral side for supporting the step body 324 from below as viewed in FIG. 7. In this embodiment, the protruding distance of the engaging step portion 320 may be determined to be larger than the protruding distance of the lengthwise linear projections 31*t* and the crosswise linear projection 31*y*.

As shown in FIG. 5, the communication pipe 36 of the pump housing 31 of the pump unit 30 may be inserted into the atmospheric port 23 of the canister 20, so that the pump disposed within the pump housing 31 can be brought to be in fluid communication within the canister 20.

Figure 3:
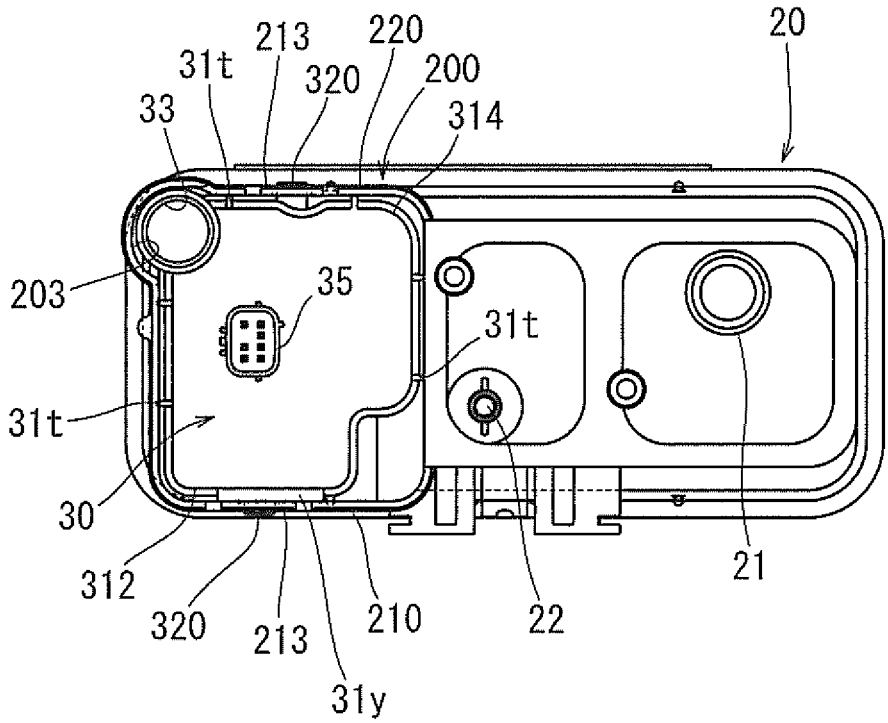
FIG. 3 is a front view as viewed in a direction indicated by arrow III in FIG. 2.
Figure 4:
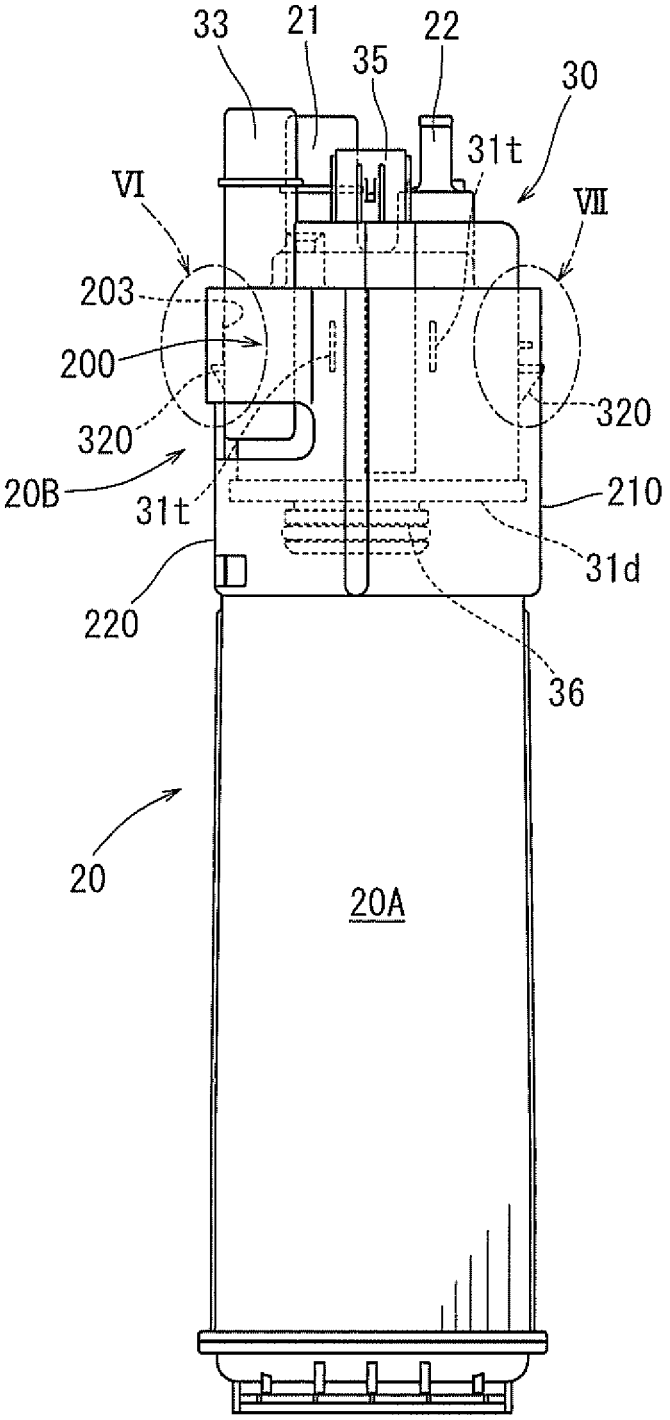
FIG. 4 is a side view as viewed in a direction indicated by arrow IV in FIG. 2.

Referring to FIGS. 3, 4 and 5, the outer peripheral wall 200 of the canister 20 may be arranged to surround the atmospheric port 23 like a fence. The outer peripheral wall 200 may be configured to be capable of fitting with the lower portion of the pump housing 31 when the communication pip 36 of the pump housing 31 is inserted into the atmospheric port 23. To this end, as shown in FIG. 3, the outer peripheral wall 200 may have a substantially rectangular tubular shape conforming to the shape of the pump housing 31 as viewed in a plan view. When the pump housing 31 has been fitted into the outer peripheral wall 200 of the canister 20, the tip end surfaces (protruding end surfaces) of the lengthwise linear projections 31*t* and the tip end surface (protruding end surface) of the crosswise linear projection 31*y* may contact the inner peripheral surface of the outer peripheral wall 200. Further, as shown in FIG. 3, the outer peripheral wall 200 may have a groove 203 having a substantially circular arc-shape as viewed in FIG. 3 at one of corner portions to correspond to shape of the outlet port 33 of the pump housing 31.

Figure 2:
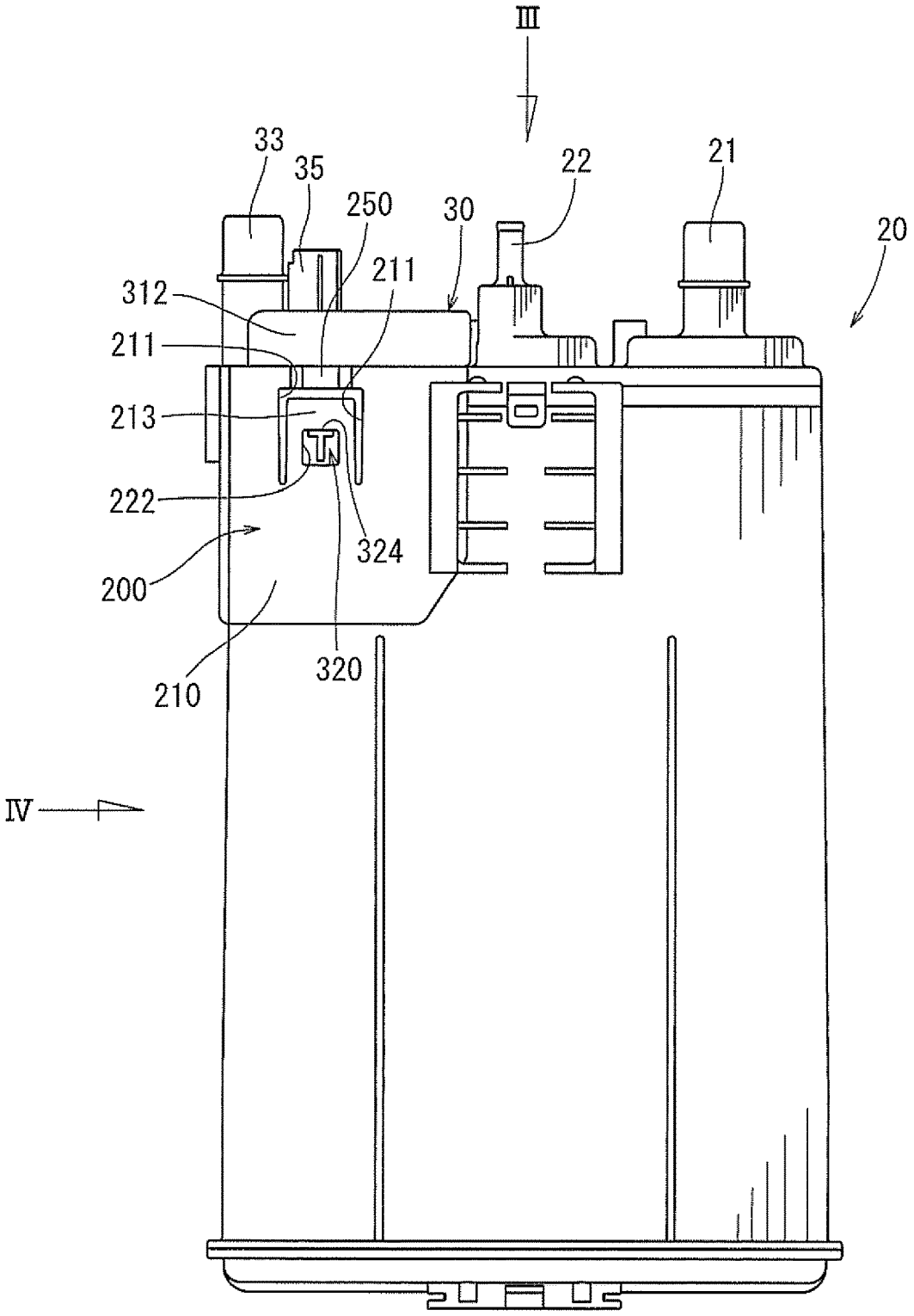
FIG. 2 is a plan view of a canister serving as a main device and a pump unit serving as an accessory device and attached to the canister of the fuel vapor processing device shown in FIG. 1.

As shown in FIG. 2, a substantially inverted U-shaped slot 211 may be formed in each of a front wall portion 210 and a back wall portion 220 of the outer peripheral wall 200 respectively facing the second outer peripheral surface portion 312 and the fourth outer peripheral surface portion 314 of the pump housing 31 (only the U-shaped slot 211 formed in the front wall portion 210 is shown in FIG. 2). Therefore, in each of the front wall portion 210 and the back wall portion 220, a wall part 213 surrounded by the slot 211 may be separated from the other wall part of the front wall portion 210 or the back wall portion 220. In this embodiment, the outer peripheral wall 200 of the canister 20 may be formed of resin. Therefore, the wall part 213 can elastically deform in a direction perpendicular to the surface of the corresponding front wall portion 210 or the back wall portion 220. In other words, the wall part 213 may serve as a spring plate. Accordingly, the wall part 213 may also be referred to as a "spring plate part." The second outer peripheral surface portion 312 and the front wall portion 210 facing each other are relatively movable in the inserting direction of the pump housing 31. In this embodiment, the inserting direction is a longitudinal direction of the pump housing 31 and is a vertical direction as viewed in FIG. 5. Similarly, the fourth outer peripheral surface portion 314 and the back wall portion 220 facing each other are relatively movable in the inserting direction of the pump housing 31.

As shown in FIG. 2, a substantially rectangular engaging opening 222 for engagement with the engaging step portion 320 of the pump housing 31 may be formed in the spring plate part 213 at a position proximal to its base end (i.e., the lower end connected to the other part of the front wall portion 210 or the back wall portion 220). The position of the engaging opening 222 may be determined such that the engaging step portion 320 engages the engaging opening 222 when the pump housing 31 has been fitted into the outer peripheral wall 200 with the communication pipe 36 inserted into the atmospheric port 23.

Figure 13:
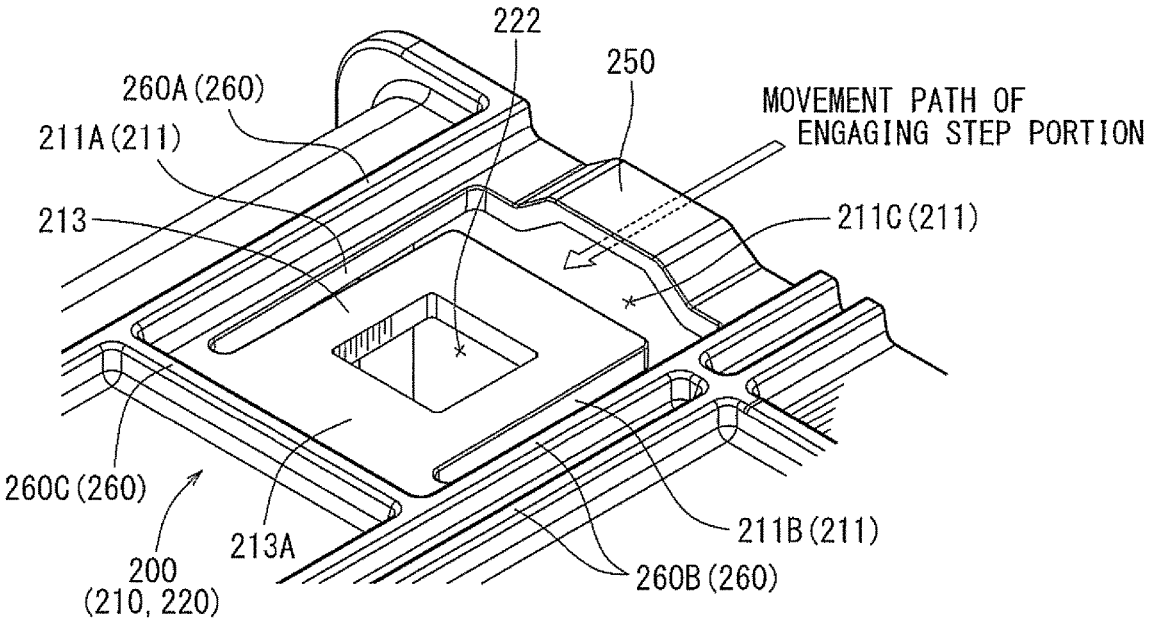
FIG. 13 is a perspective view of a part including a bridging portion of a peripheral wall portion of the canister serving as a snap-fit attaching device.

FIG. 13 illustrates an enlarged perspective view of a part of the front wall portion 210 or the back wall portion 220 around the spring plate part 213. The substantially inverted U-shaped slot 211 forming the spring plate part 213 may include a left slot part 211A, a right slot part 211B and an upper slot part 211C as viewed in FIG. 13. The upper slot part 211C connects the upper portions of the left slot part 211A and the right slot part 211B. In this way, the spring plate part 213 is configured to have a cantilever support structure and can elastically deform about a support portion 213A that is the base end or the lower end connected to the other part of the front wall portion 210 or the back wall portion 220. As previously described, the engaging opening 222 may be formed in the spring plate part 213 and may engage the corresponding engaging step portion 320 that is not shown in FIG. 13 but is shown in FIGS. 8, 11 and 12.

As shown in FIG. 13, each of the front wall portion 210 and the back wall portion 220 of the outer peripheral wall 200 may include a bridging portion 250 positioned on the upper side of the upper slot part 211C. The bridging portion 250 may serve to connect between portions of the front wall portion 210 or the back wall portion 220, which are located on the left side of the left slot part 211A and the right side of the right slot part 211B. In other words, the bridging portion 250 serve as a part of the upper edge portion of each of the front wall portion 210 and the back wall portion 220 of the outer peripheral wall 200. Therefore, the rigidity of the upper edge portion of each of the front wall portion 210 and the back wall portion 220 facing the spring plate part 213 can be improved. Thus, in the case of the related art shown in FIG. 21, the upper side of the opening forming portion 1213 corresponding to the spring plate part 213 of this embodiment is opened, and for this reason, the upper edge of an outer peripheral wall having the opening forming portion 1213 may be exhibit relatively low rigidity. In contrast, by providing the bridging portion 250 bridging the upper portions of the left and right slot parts 211A and 211B, embodiments described herein offer the potential to avoid or prevent a reduction in the rigidity of the upper edge portion of the outer peripheral wall 200 caused by the formation of the spring plate part 213.

As shown in FIG. 13, the bridging portion 250 may be configured not to interfere with the corresponding engaging step portion 320 of the pump housing 31 during the movement of the engaging step portion 320 along the moving path for engagement with the engaging opening 222 formed in the corresponding spring plate part 213. More specifically, a portion of the bridging portion 250 located in the moving path may be bent outward, whereby the engaging step portion 320 may not contact the bridging portion 250 during the movement for engagement with the engaging opening 222. Further, forming the outwardly bent part on the bridging portion 250 may improve the rigidity of the bridging portion 250 itself.

As shown in FIG. 13, a reinforcement rib structure 260 may be integrally formed on each of the front wall portion 210 and the back wall portion 220 of the outer peripheral wall 200. The reinforcement rib structure 260 may include a left rib 260A disposed along the left side of the left slot part 211A, a pair of right ribs 260B disposed in parallel to each other along the right side of the right slot part 211B, and a connection rib 260C disposed along the support portion 213A of the spring plate part 213 and connecting the left rib 260A to one of the pair of right ribs 260B. In this way, the left rib 260A, the pair of right ribs 260B and the connection rib 260C are arranged to surround the spring plate part 213. As a result, the rigidity of the outer peripheral wall 200 at regions around the spring plate parts 213 can be further enhanced.

To assemble the pump unit 30 to the canister 20, the pump unit 30 may be moved in the inserting direction relative to the canister 20 such that the communication pipe 36 is inserted into the atmospheric port 23 and that the pump housing 31 is fitted into the circumferential wall 200 as shown in FIG. 5. In this embodiment, the inserting direction is parallel to the longitudinal direction of the pump unit 30 and is also parallel to the longitudinal direction of the canister 20 and the axial direction of the communication pipe 36. During this movement, the outlet port 33 of the pump housing 31 of the pump unit 30 may be positioned to align with the groove 203 of the outer peripheral wall 200 of the canister 20.

As the pump unit 30 moves in the inserting direction, the inclined surfaces 31*k* of the lengthwise linear projections 31*t* formed on the outer peripheral surface of the pump housing 31 may first slidably contact the inner surface of the upper end of the outer peripheral wall 200 of the canister 20. Therefore, the pump unit 30 may be positioned relative to the outer peripheral wall 200 with respect to the radial direction of the communication pipe 36. As the pump unit 30 moves further in the inserting direction, the tip end surfaces (protruding end surfaces) of the lengthwise linear projections and the crosswise linear projection 31*y* formed on the outer peripheral surface of the pump housing 31 may slidably contact the inner peripheral surface of the outer peripheral wall 200, so that the communication pipe 36 of the pump unit 30 can be held to align with the atmospheric port 23 of the canister 20. In this manner, the communication pipe 36 can be inserted into the atmospheric port 23 as the pump housing 31 of the pump unit 30 is fitted into the outer peripheral wall 200 of the canister 20.

Figure 6:
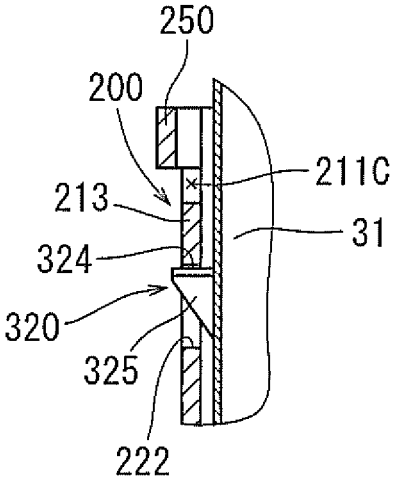
FIG. 6 is a sectional view of a part indicated by arrow VI in FIG. 4.
Figure 7:
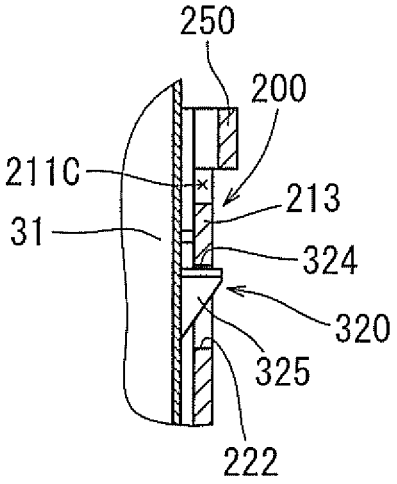
FIG. 7 is a sectional view of a part indicated by arrow VII in FIG. 4.

As the pump unit 30 is fitted into the outer peripheral wall 200 of the canister, the rib portions 325 of the engaging step portions 320 may force the corresponding spring plate parts 213 to elastically deform outward. At the same time the communication pipe 36 of the pump unit 30 has been inserted into the atmospheric port 23 of the canister 20 by a predetermined insertion distance, the engaging step portions 320 may reach to positions where they face to the engaging openings 222 of the spring plate parts 213 (FIG. 2). Therefore, the spring plate parts 213 may elastically recover their shapes, so that the engaging step portions 320 move into and engage the corresponding engaging openings 222 at their peripheral edges as shown in FIGS. 6 and 7. As a result, the engaging step portions 320 may be snap-fitted into the engaging openings 222. Thus, each of the engaging step portions 320 of the pump unit 30, the corresponding spring plate part 213 formed on the outer peripheral wall 200 of the canister 20, and the corresponding engaging opening 222 formed in the spring plate parts 213 may serve as a snap-fit attaching device. Hence, the pump unit 30 can be fixed in position relative to the outer peripheral wall 200 of the canister 20, and the assembling operation of the pump unit 30 to the canister 20 may be completed.

During the fitting operation of the pump unit 30 into the outer peripheral wall 200, the bridging portions 250 of the outer peripheral wall 200 may not interfere with the engaging step portions 320 of the pump unit 30 as shown in FIG. 13. Thus, each of the bridging portions 250 is configured not to be positioned in the movement path of the corresponding engaging step portion 320. Therefore, the pump unit 30 can smoothly move for fitting with the outer peripheral wall 200.

In the embodiment described above, there are provided snap-fitting devices between the outer peripheral wall 200 of the canister 20 and the pump housing 31 of the pump unit 30. The snap-fitting devices each include the engaging step 320, the spring plate part 213, and the engaging opening 222. The snap-fit attaching devices can elastically engage the pump unit 30 with the outer peripheral wall 200 of the canister 20 to fix the pump unit 30 in position relative to the canister 20 when the pump unit 30 (pump housing 31) has been fitted into the outer peripheral wall 200 to reach a predetermined position. Further, as the pump unit 30 is fitted into the outer peripheral wall 200 of the canister 20, the communication pipe 36 may be connected to the atmospheric port 23 of the canister 20. In this manner, the pump unit 30 can be fixed in position relative to the canister 20 by simply fitting the pump unit 30 into the outer peripheral wall 200 of the canister 20 to reach a predetermined position, and therefore, it is possible to reduce the number of necessary assembling steps in comparison with a case where the pump unit 30 is fixed to the canister 20 by using bolts or the like separate fasteners. Further, because the pump unit 30 is fitted into the outer peripheral wall 200 of the canister 20, it may be possible to fix the pump unit 30 in stable relative to the canister 20 even in the case where the pump unit 30 has a relatively large weight.

Further, the lengthwise linear projections 31*t* and the crosswise linear projection 31*y* are formed on the outer peripheral surface of the pump unit 30 and are distributed around the central portion of the pump unit 30. Because the tip end surfaces (protruding end surfaces) of these linear projections 31*t* and 31*y* contact the inner peripheral surface of the outer peripheral wall 200 of the canister 20, it is possible to prevent shifting movement (rattling) of the pump unit 30 relative the canister 20.

Further, the bridging portions 250 are formed on the front wall portion 210 and the back wall portion 220 of the outer peripheral wall 200 and each faces to the upper slot part 211C of the slot 211 defining the corresponding spring plate part 213. Therefore, it is possible prevent or minimize potential vibrations of the pump unit 30 that may be produced during travelling of the vehicle. In particular, it is possible to provide a remarkable effect in preventing or minimizing a strong vibration that may be applied to the pump unit 30 during travelling of the vehicle on a waved highway road surface.

Furthermore, the reinforcement rib structures 260 formed on the outer peripheral wall 200 may increase the rigidity of the outer peripheral wall 200, in particular the rigidity of the regions around the splint plate parts 213. Therefore, it may be possible to further prevent or minimize potential vibrations of the pump unit 30.

Referring now to FIGS. 14 to 17, a second embodiment will now be described. The second embodiment is a modification of the first embodiment and is different from the first embodiment in that the main unit 20A and the attachment unit 20B of the canister 20 are configured as separate units from each other. In the following description, like members are given the same reference numerals as the first embodiment and the description of the same will be omitted.

Figure 14:
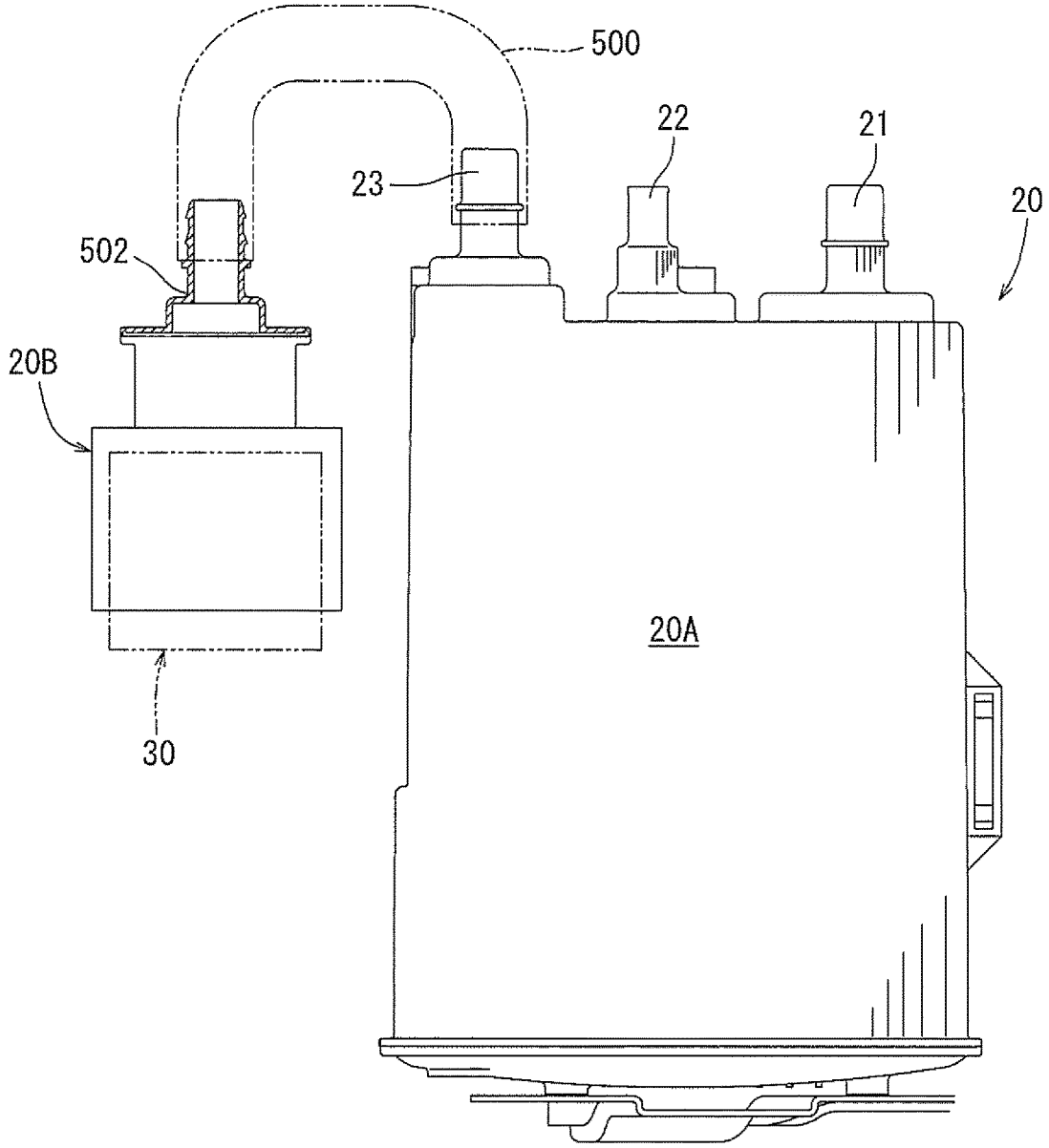
FIG. 14 is a schematic view of a main unit and an attachment unit of an embodiment of a main device of a fuel vapor processing apparatus in accordance with principles described herein.

Referring first to FIG. 14, the main unit 20A and the attachment unit 20B are connected to each other via a communication pipe 500. The main unit 20A and the attachment unit 20B may be arranged under the floor of the vehicle, where the fuel tank T (FIG. 1) may be arranged. By configuring the main unit 20A and the attachment unit 20B as separate units, it is possible to suitably determine the arrangement positions of the main unit 20A and the attachment unit 20B according to the relationship with the other vehicle components or the shape of the floor. Therefore, it is possible to enhance the flexibility in the arrangement of the canister 20.

Similar to the first embodiment, the main unit 20A may contain the adsorbent 12 (not shown in FIG. 14) for adsorbing fuel vapor. Further, the main unit 20A may include the tank port 21, the purge port 22 and the atmospheric port 23. One end of the communication pipe 500 may be connected to the atmospheric port 23, and the other end of the communication pipe 500 may be connected to the attachment unit 20B via an attachment fitting 502 that may be integrated with the attachment unit 20B.

In FIG. 14, the pump unit 30 is schematically shown in the fitted state into the attachment unit 20B. The attachment unit 20B of the second embodiment is shown in detail in FIGS. 15 to 17. The construction of the pump unit 30 of the second embodiment is basically the same as the construction of the pump unit 30 of the first embodiment shown in FIGS. 8 to 12. In particular, the arrangement and the construction of the engaging step portions 320 each constituting the snap-fit attaching device may be the same as those of the first embodiment.

Figure 15:
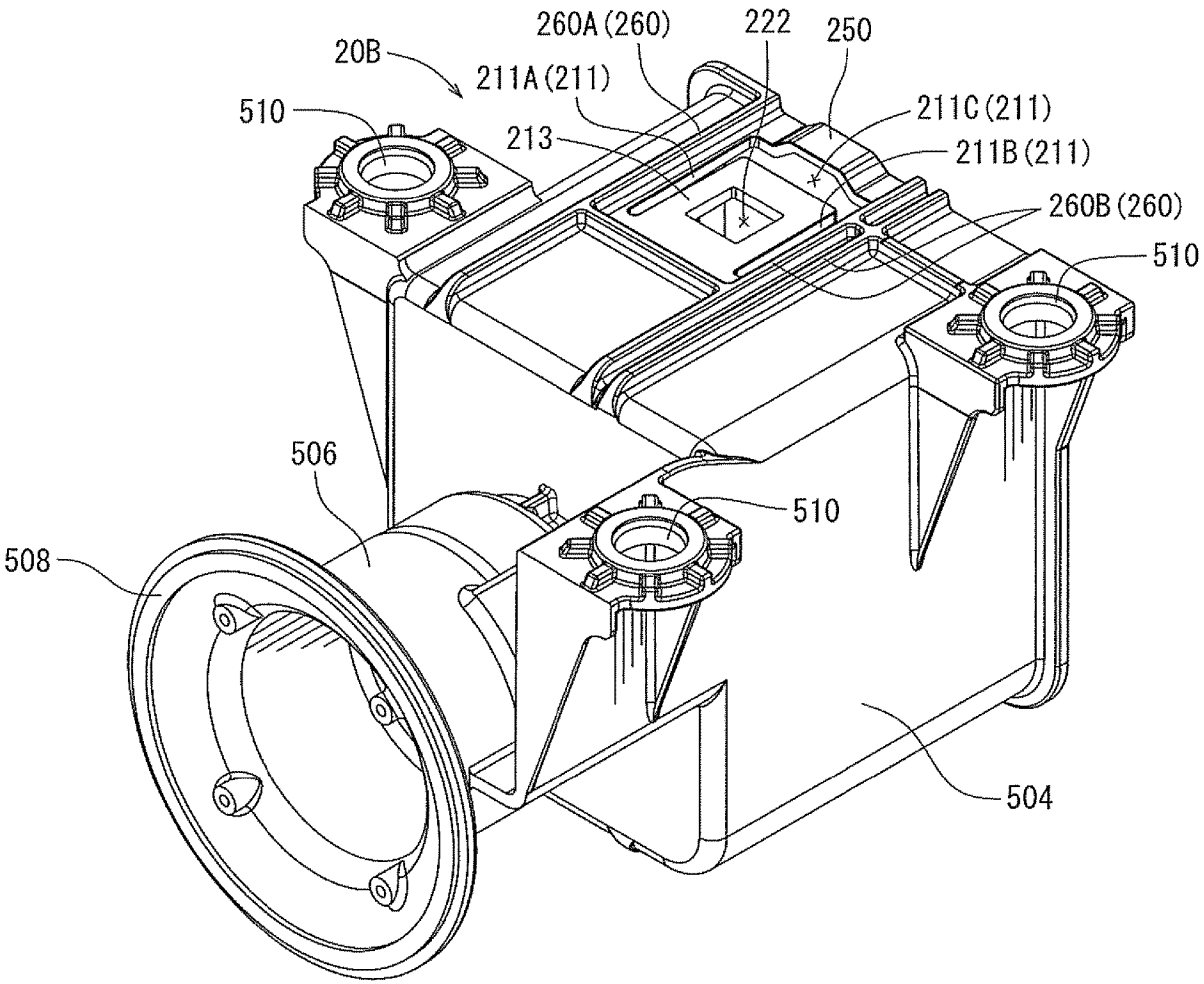
FIG. 15 is a perspective view of the attachment unit of FIG. 14 as viewed from an attachment side for attachment to a lower side of a vehicle floor.
Figure 16:
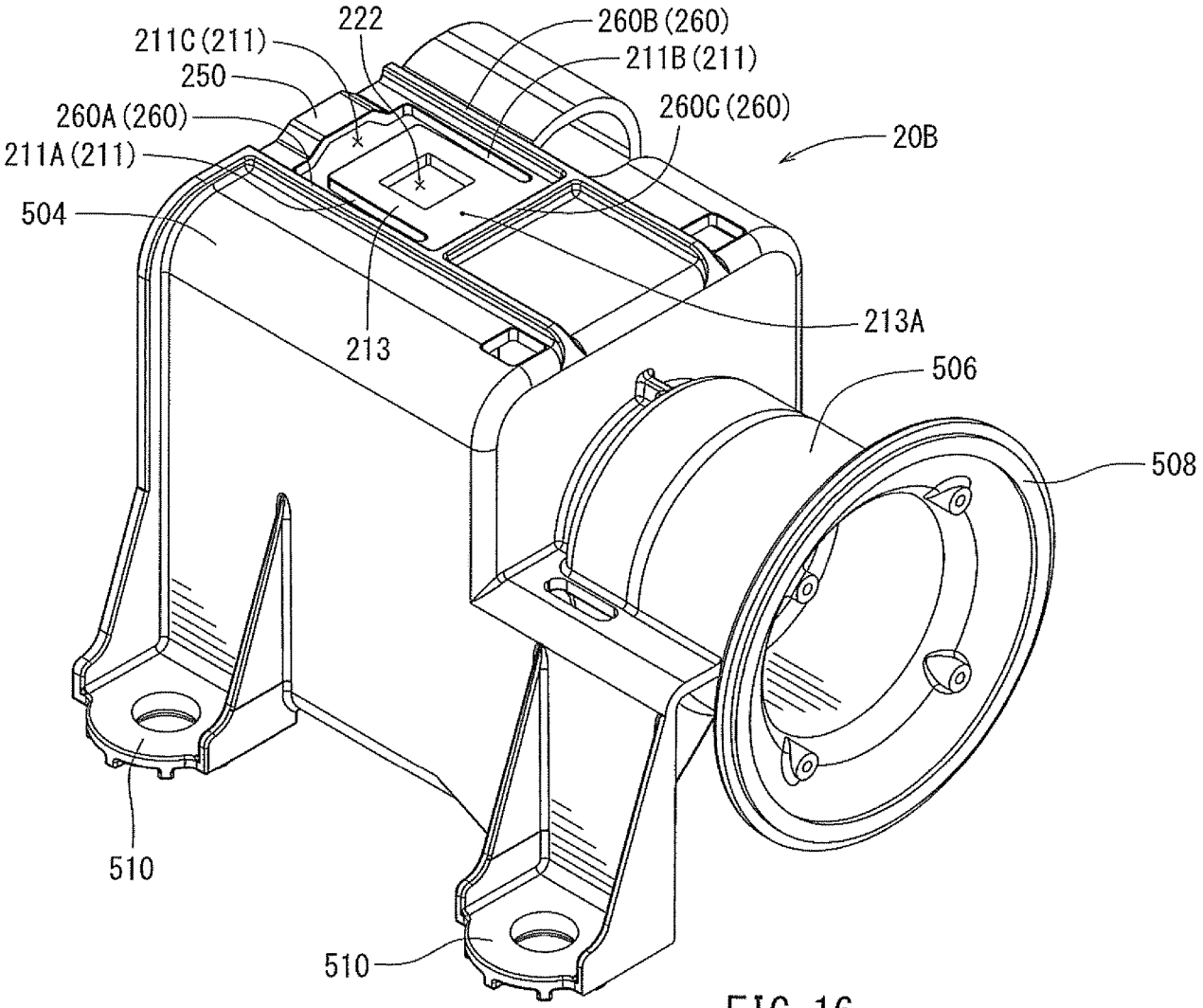
FIG. 16 is a perspective view of the attachment unit of FIG. 14 as viewed from a side opposite to the attachment side.
Figure 17:
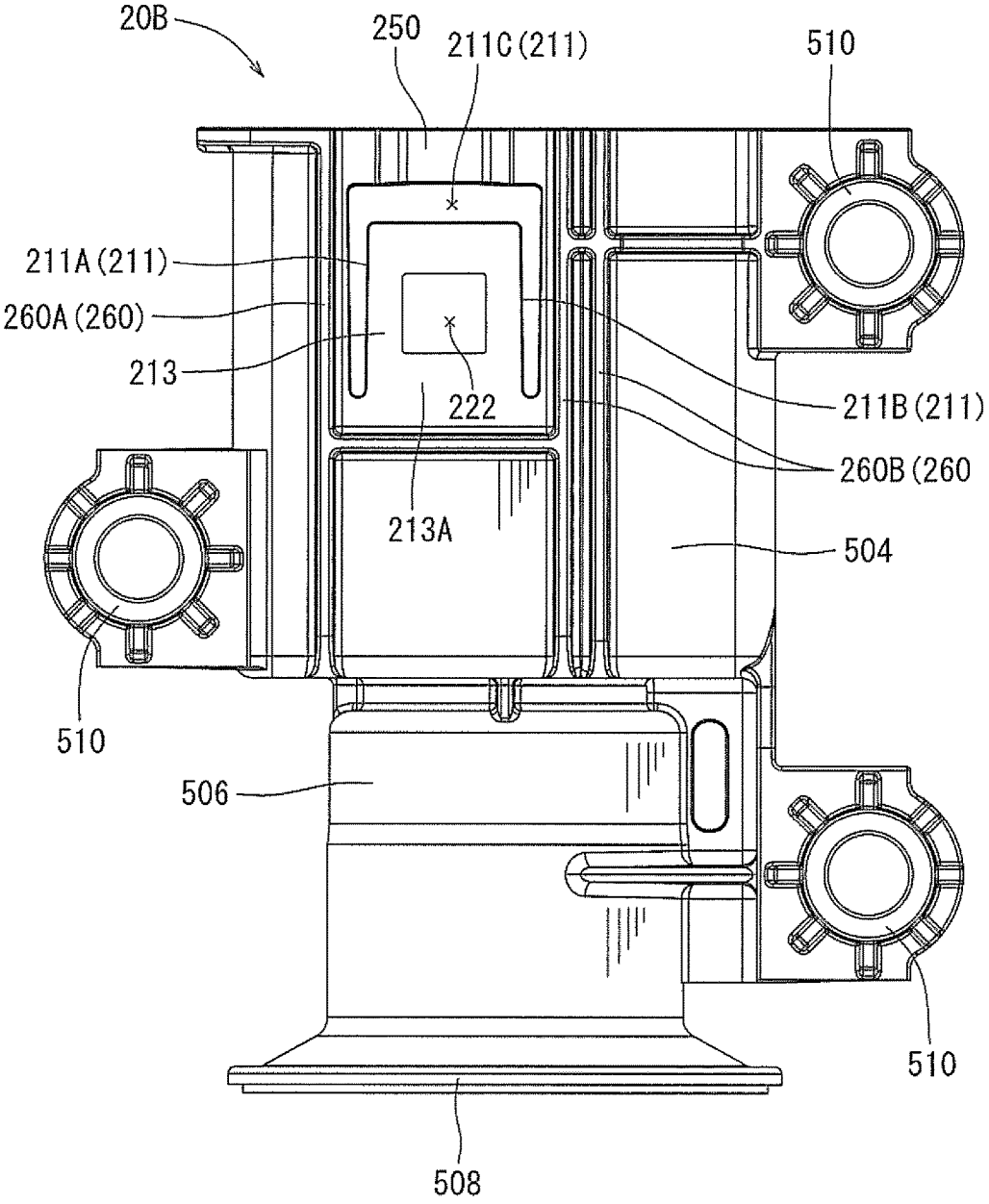
FIG. 17 is a plan view of the attachment unit of FIG. 14 as viewed form the attachment side.

As shown in FIGS. 15 to 17, the attachment unit 20B of the second embodiment may include an attachment unit body 504, a storage housing 506 and a connecting member 508. The attachment unit body 504 is configured such that the pump unit 30 can be fitted into the attachment unit body 504. Therefore, a basic structure of the attachment unit body 504 may be the same as the outer peripheral wall 200 of the first embodiment. More specifically, the same structure as shown in FIG. 13 for the front wall portion 210 (back wall portion 220) of the first embodiment may be provided on each of opposite wall portions of the attachment unit body 504 (one of the opposite wall portions being shown in FIG. 15, and the other of the opposite wall portions being shown in FIG. 16). In FIGS. 15 and 16, portions and constructions similar to those shown in FIG. 13 are labelled with the same reference numerals as in FIG. 13. Thus, each of the opposite wall portions of the attachment unit body 504 is provided with the snap-fit attaching device and is also provided with the bridging portion 250 and the reinforcement rib structure 260.

The connecting member 508 may be connected to the attachment fitting 502 that is fitted into the end of the communication pipe 500, so that the attachment unit 20B can be connected to the communication pipe 500. The storage housing 506 may be connected between the attachment unit body 504 and the connecting member 508. The adsorbent 12 (not shown in FIGS. 15 to 17) may be contained in the storage housing 506. Therefore, in this embodiment, the adsorbent 12 may be contained in each of the main unit 20A and the attachment unit 20B of the canister 20. Hence, it is possible to increase an ability for processing the fuel vapor. Further, in this embodiment, the attachment unit 20B includes three attachment portions 510 that can be used for attaching to the vehicle floor by bolts or any other suitable fasteners.

The second embodiment is different from the first embodiment in the arrangement of the main unit 20A and the attachment unit 20B of the canister 20. However, the construction of the attachment unit body 504 of the attachment unit 20B for fitting with the pump unit 30 is basically the same as the outer peripheral wall 200 of the attachment unit 20B of the first embodiment. Therefore, the operation for attaching the pump unit 30 to the attachment unit body 504 will not be described because this operation may be the same as the operation for attaching the pump unit 30 to the outer peripheral wall 200. Further, the advantages of the snap-fit attaching devices, the bridging portions 250 and the reinforcement rib structures 260 of the second embodiment are the same as those in the first embodiment.

Figure 18:
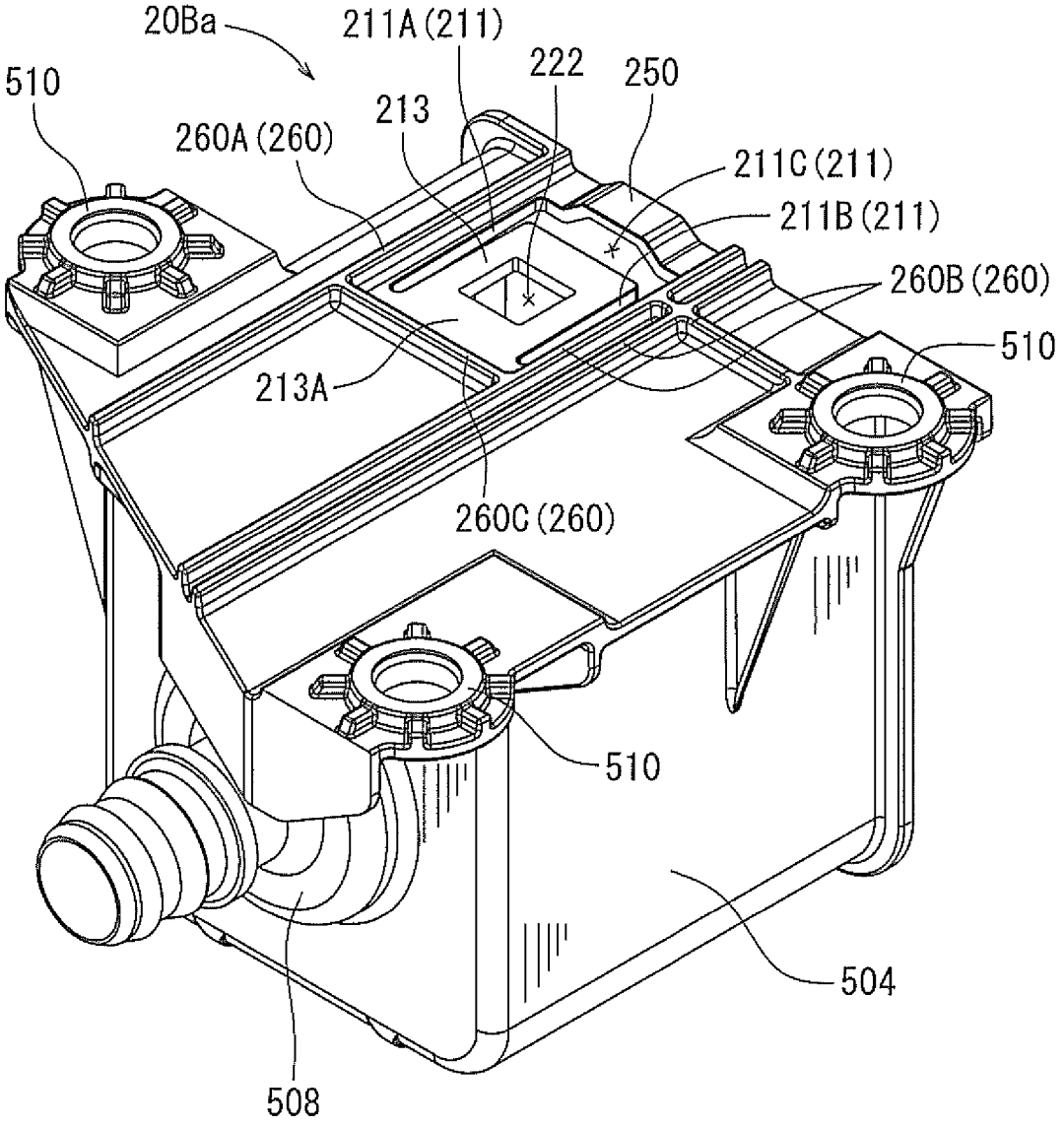
FIG. 18 is a perspective view of an embodiment of an attachment unit of a fuel vapor processing apparatus in accordance with principles described herein as viewed from an attachment side for attachment to a lower side of a vehicle floor.
Figure 19:
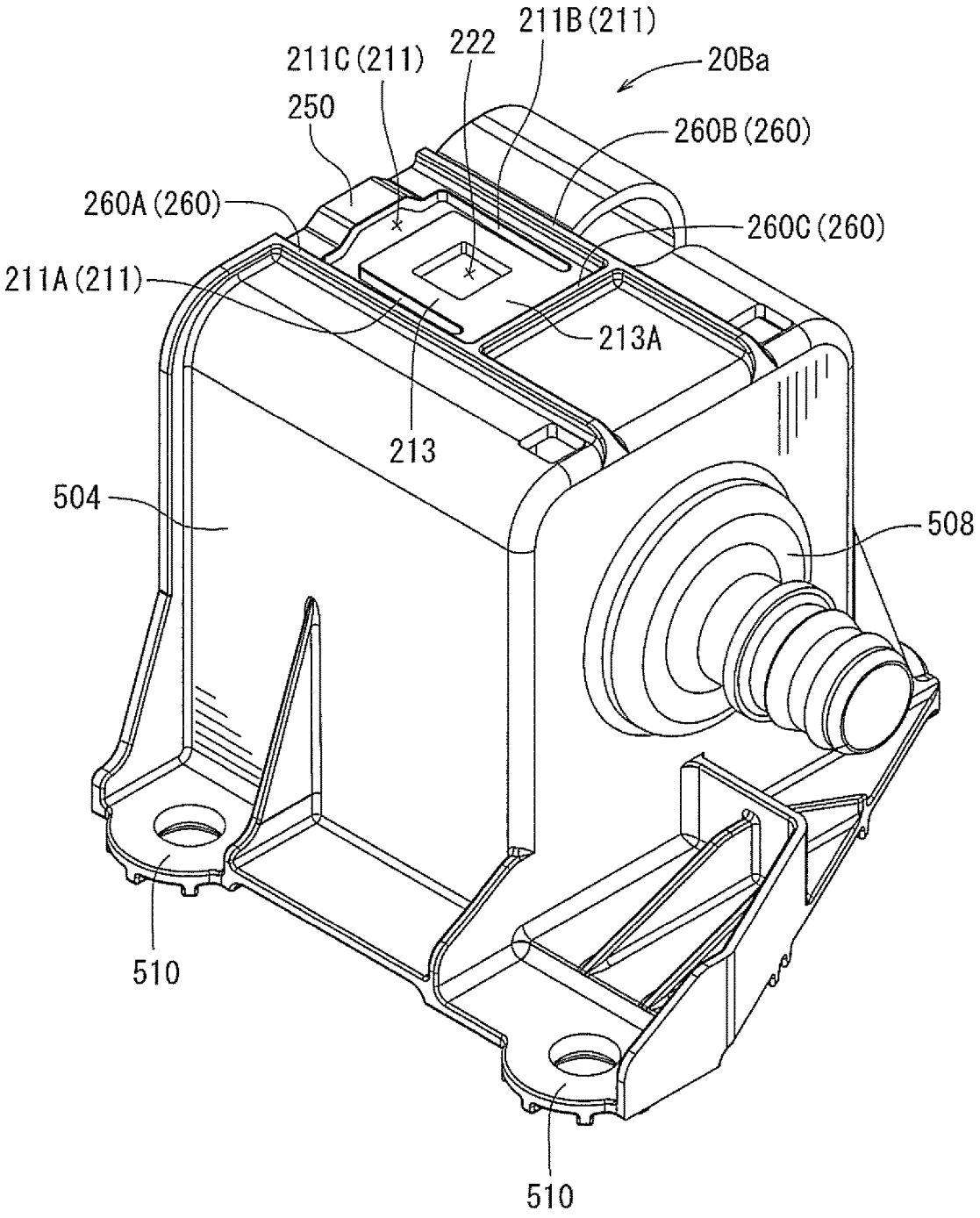
FIG. 19 is a perspective view of the attachment unit of FIG. 18 as viewed from a side opposite to the attachment side.
Figure 20:
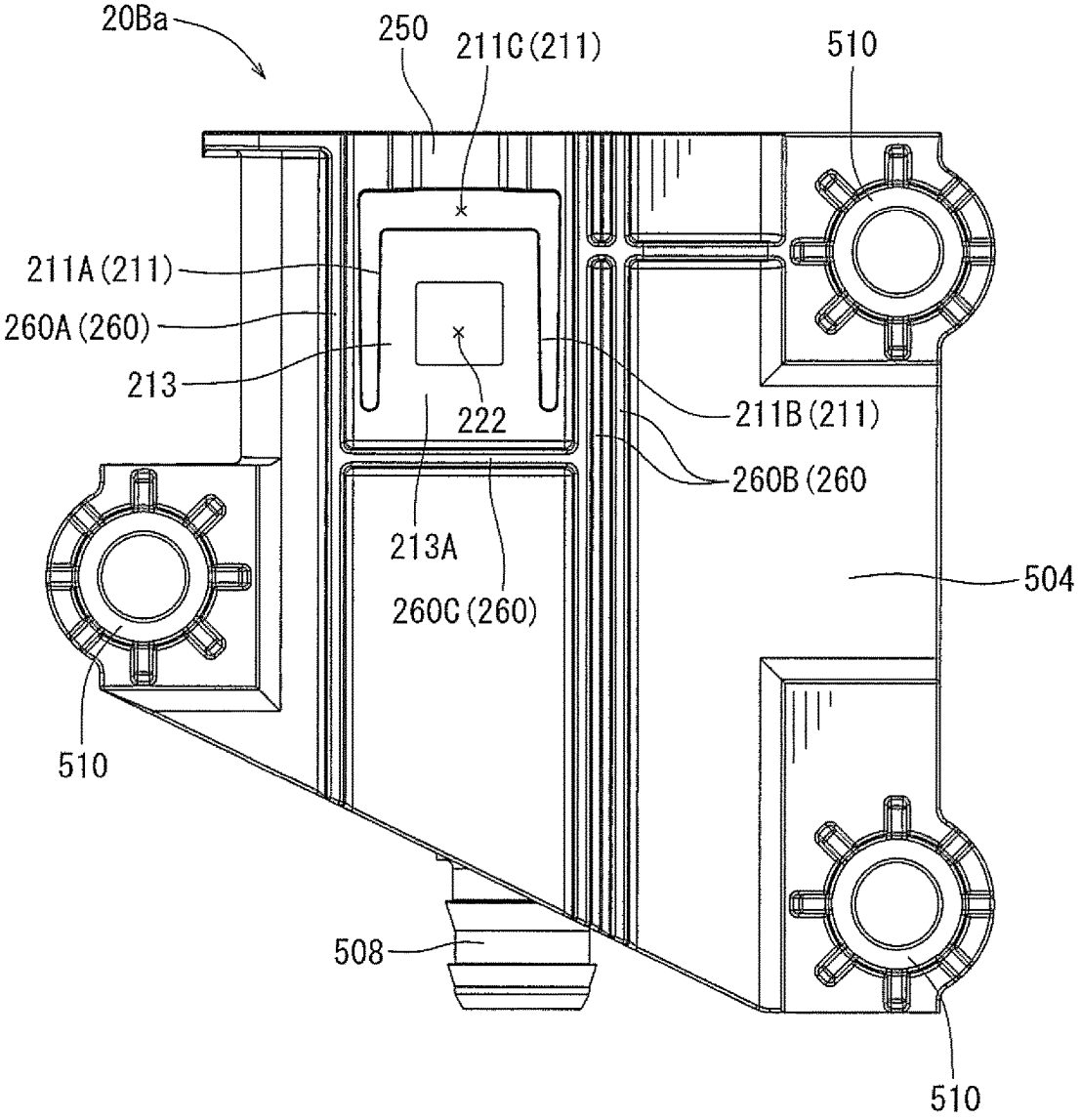
FIG. 20 is a plan view of the attachment unit of FIG. 0.18 as viewed form the attachment side.

Referring now to FIGS. 18 to 20, a third embodiment will now be described. The third embodiment is a modification of the second embodiment and is different from the second embodiment in that the attachment unit 20B is replaced with an attachment unit 20Ba shown in FIGS. 18 to 20. In other respects, the third embodiment may be the same as the second embodiment.

The attachment unit 20Ba is different from the attachment unit 20B of the second embodiment in that the storage housing 506 is omitted. Thus, the connecting member 508 is directly connected to the attachment unit body 504. The attachment unit 20Ba may be used in place of the attachment unit 20B of the second embodiment, if no additional adsorbent is necessary. Therefore, the attachment unit 20Ba is simple in construction and may occupy a smaller space when arranged under the floor of the vehicle.

The operation for attaching the pump unit 30 to the attachment unit body 504 of the third embodiment will not be described because this operation may be the same as the operation of the second embodiment. Further, the advantages of the snap-fit attaching devices, the bridging portions 250 and the reinforcement rib structures 260 of the second embodiment are the same as those in the first embodiment.

Although the pump unit 30 was illustrated as an accessory device for attaching to the canister 20 in the above embodiments, the teachings of the above embodiments may be applied to any other accessory devices. For example, although the solenoid valve 16*v* is disposed in the purge passage 16 in the above embodiments, the solenoid valve 16*v* may be attached to the purge port 22 of the canister 30. In such a case, the solenoid valve 16*v* may serve as an accessory device and a structure like the outer peripheral wall 200 may be formed around the purge port 22 for fitting with the solenoid valve 16*v*. It may be also possible to apply the above teachings to an air filter serving as an accessory device attached to the atmospheric port 23. Further, any other filter devices may be used as accessory devices.

Further, although the lengthwise linear projections 31*t* and the crosswise linear projection 31*y* are formed on the outer peripheral surface of the pump unit 30 in the above embodiments, it may be possible to replace the crosswise linear projection 31*y* with a lengthwise linear projection or to replace the lengthwise linear projections 31*t* with crosswise linear projections, so that all of the linear projections are lengthwise linear projections or crosswise linear projections.

The various examples described above in detail with reference to the attached drawings are intended to be representative of the invention and thus not limiting. The detailed description is intended to teach a person of skill in the art to make, use and/or practice various aspects of the present teachings and thus is not intended to limit the scope of the invention. Furthermore, each of the additional features and teachings disclosed above may be applied and/or used separately or with other features and teachings to provide improved fuel vapor processing apparatuses, and/or methods of making and using the same.

Moreover, the various combinations of features and steps disclosed in the above detailed description may not be necessary to practice the invention in the broadest sense, and are instead taught to describe representative examples of the invention. Further, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed as informational, instructive and/or representative and may thus be construed separately and independently from each other. In addition, all value ranges and/or indications of groups of entities are also intended to include possible intermediate values and/or intermediate entities for the purpose of original written disclosure, as well as for the purpose of restricting the claimed subject matter.

What is claimed is:

1. A fuel vapor processing apparatus, comprising:

a main device configured to receive and process fuel vapor produced in a fuel tank, wherein the main device comprises a main unit and an attachment unit that communicate with each other via a fuel vapor passage, wherein the attachment unit includes a first structural member;

an accessory device including a second structural member; and a snap-fit attaching device configured to attach the second structural member to the first structural member, wherein the snap-fit attaching device comprises:

a slot formed in the first structural member, an engaging opening forming member defined by the slot, and an engaging opening formed in the engaging opening forming member, wherein the slot is formed to surround the engaging opening forming member, so that the engaging opening forming member is supported by the first structural member in a cantilever manner at a support portion so as to be elastically deformable; and an engaging projection disposed at the second structural member and configured to engage the engaging opening through elastic deformation of the engaging opening forming member when the second structural member moves relative to the first structural member in an attaching direction;

wherein the first structural member further includes a bridging portion facing a part of the slot on a side opposite to the support portion, wherein the bridging portion connects portions of the first structural member disposed on opposite sides of the engaging opening forming member with respect to a direction along the part of the slot.

2. The fuel vapor processing apparatus according to claim 1, wherein:

the bridging portion is configured not to interfere with the engaging projection during the movement of the second structural member in the attaching direction.

3. The fuel vapor processing apparatus according to claim 1, wherein:

the first structural member further includes a reinforcement rib structure disposed around the engaging opening forming member and formed integrally with the first structural member.

4. The fuel vapor processing apparatus according to claim 1, wherein:

the accessory unit comprises a pump unit used for a failure diagnosis of the fuel vapor processing apparatus.

5. The fuel vapor processing apparatus according to claim 1, wherein:

the main unit of the main device comprises a canister that contains adsorbent.

6. The fuel vapor processing apparatus according to claim 1, wherein:

the main unit and the attachment unit of the main device are integrated with each other.

7. The fuel vapor processing apparatus according to claim 1, wherein:

the main unit and the attachment unit of the main device are separated from each other and are connected to each other via a communication pipe.

8. The fuel vapor processing apparatus according to claim 7, wherein:

the attachment unit of the main device contains adsorbent.

9. The fuel vapor processing apparatus according to claim 7, wherein:

the attachment unit of the main device contains no adsorbent.

10. The fuel vapor processing apparatus according to claim 1, wherein:

the first structural member comprises a peripheral wall configured to be fitted with the second structural member.

11. A fuel vapor processing apparatus comprising:

a canister containing adsorbent for adsorbing fuel vapor produced in a fuel tank;

an accessory device;

a first wall portion disposed at one of the canister and the accessory device;

a second wall portion disposed at the other of the canister and the accessory device;

a snap-fit attachment device configured to detachably attach the accessory device to the canister, wherein the attachment device comprises:

a slot formed in the first wall portion, an elastically deformable member surrounded by the slot, and an engaging opening formed in the elastically deformable member, wherein the slot is configured not to be opened at a peripheral edge of the first wall portion; and an engaging projection disposed at the second wall portion and configured to engage the engaging opening;

wherein as the first wall portion moves relative to the second wall portion in an attachment direction, the elastically deformable member elastically deforms from an original shape due to interaction with the engaging projection, and the elastically deformable member elastically recovers the original shape to cause engagement of the engaging projection with the engaging opening when the engaging opening is positioned to face the engaging projection.

12. The fuel vapor processing apparatus according to claim 11, wherein:

a peripheral portion of the first wall portion around the elastically deformable portion is configured not to interact with the engaging projection during the movement of the first wall portion in the attachment direction relative to the second wall portion.

13. The fuel vapor processing apparatus according to claim 11, further comprising:

a fluid connection device configured to connect the accessory device to the canister in fluid communication therewith when the accessory device is attached to the canister via the attachment device.

14. A fuel vapor processing apparatus comprising:

a canister containing adsorbent for adsorbing fuel vapor produced in a fuel tank;

an attachment unit connected to the canister via a connection pipe;

an accessory device;

a first wall portion disposed at one of the attachment unit and the accessory device;

a second wall portion disposed at the other of the attachment unit and the accessory device;

a snap-fit attachment device configured to detachably attach the accessory device to the attachment unit, the attachment device comprising:

a slot formed in the first wall portion, an elastically deformable member surrounded by the slot, and an engaging opening formed in the elastically deformable member, wherein the slot is configured not to be opened at a peripheral edge of the first wall portion; and an engaging projection disposed at the second wall portion and configured to engage the engaging opening;

wherein as the first wall portion moves relative to the second wall portion in an attachment direction, the elastically deformable member elastically deforms from an original shape due to interaction with the engaging projection, and the elastically deformable member elastically recovers the original shape to cause engagement of the engaging projection with the engaging opening when the engaging opening is positioned to face the engaging projection.

15. The fuel vapor processing apparatus according to claim 14, wherein:

a peripheral portion of the first wall portion around the elastically deformable portion is configured not to interact with the engaging projection during the movement of the first wall portion in the attachment direction relative to the second wall portion.

16. The fuel vapor processing apparatus according to claim 14, further comprising:

a fluid connection device configured to connect the accessory device to the attachment unit in fluid communication therewith when the accessory device is attached to the attachment unit via the attachment device.

17. The fuel vapor processing apparatus according to claim 16, wherein:

the attachment unit contains adsorbent therein.

* * * * *